US011152735B2

(12) United States Patent
Cheng et al.

(10) Patent No.: US 11,152,735 B2
(45) Date of Patent: Oct. 19, 2021

(54) ELECTRICAL CONNECTOR

(71) Applicant: ALLTOP ELECTRONICS (SUZHOU) LTD., Suzhou (CN)

(72) Inventors: Ihung Cheng, New Taipei (TW); Qiqing Dai, Suzhou (CN); Siumien Yang, New Taipei (TW); Wangi Yu, New Taipei (TW)

(73) Assignee: ALLTOP ELECTRONICS (SUZHOU) LTD., Suzhou (CN)

( * ) Notice: Subject to any disclaimer, the term of this patent is extended or adjusted under 35 U.S.C. 154(b) by 671 days.

(21) Appl. No.: 16/074,069

(22) PCT Filed: Oct. 13, 2017

(86) PCT No.: PCT/CN2017/106087
§ 371 (c)(1),
(2) Date: Jul. 30, 2018

(87) PCT Pub. No.: WO2019/056419
PCT Pub. Date: Mar. 28, 2019

(65) Prior Publication Data

US 2021/0210888 A1 Jul. 8, 2021

(30) Foreign Application Priority Data

Sep. 21, 2017 (CN) ..... 201710860285.X

(51) Int. Cl.
*H01R 13/436* (2006.01)
*H01R 13/422* (2006.01)

(52) U.S. Cl.
CPC ..... *H01R 13/4368* (2013.01); *H01R 13/4223* (2013.01); *H01R 13/4365* (2013.01)

(58) Field of Classification Search
None
See application file for complete search history.

(56) References Cited

U.S. PATENT DOCUMENTS 4,944,696 A 7/1990 Sueyoshi et al.
9,728,884 B1 * 8/2017 Sinha ..... H01R 13/4364

FOREIGN PATENT DOCUMENTS

CN 1205121 A 1/1999
CN 202308462 U 7/2012
CN 203367597 U 12/2013
JP S59-36860 Y2 10/1984

* cited by examiner

*Primary Examiner* — Ross N Gushi
(74) *Attorney, Agent, or Firm* — Cheng-Ju Chiang

(57) ABSTRACT

An electrical connector comprising an insulative housing and a retainer assembled into the insulative housing. The insulative housing has a mating face and a mounting face opposite to each other, and comprises a plurality of passageways passing through thereof along a front-and-back direction for receiving corresponding contacts and a receiving cavity recessed backwards from the mating face. The retainer is provided with a plurality of first latching portions and a plurality of second latching portions, and the first latching portions and the second latching portions are staggered along the front-and-back direction, the retainer is assembled and locked in the insulative housing without dropping out of the insulative housing via the first latching portions; after the contacts assembled into the insulative housing, the retainer is pushed towards the mounting face by an external force, until the second latching portions locked in receiving cavity.

20 Claims, 10 Drawing Sheets

ELECTRICAL CONNECTOR

CROSS REFERENCE OF THE RELATED APPLICATIONS

This application is a 35 U.S.C. § 371 National Phase conversion of International (PCT) Patent Application No. PCT/CN2017/106087, filed on Oct. 13, 2017, which claims priority of the Chinese patent application No. 201710860285.X, filed on Sep. 21, 2017 and with the title of "electrical connector", which is incorporated herein by reference in its entirety. The PCT International Patent Application was filed in Chinese.

FIELD OF THE INVENTION

The present invention relates to an electrical connector, and more particularly to an electrical connector with convenient assembly and better retention force.

BACKGROUND OF THE INVENTION

A conventional electrical connector used in automobile industry, usually includes an insulative housing, a plurality of contacts and a retainer. The retainer is used for locking the contacts and enhancing the retaining force of the contact in the insulative housing. A common retainer generally has two states: preassembled in the insulative housing and detached from the insulative housing, however, the retainer may be pushed by mistake before the contacts inserted into the insulative housing, and may drop out of the preassembled position or even be lost, on the other hand, an additional tool is needed to push the retainer into the insulative housing.

Hence, it is desired to provide an electrical connector to overcome the problems mentioned above.

SUMMARY OF THE INVENTION

Accordingly, an object of the present invention is to provide an electrical connector with a sufficient contact holding force can be assembled conveniently.

The present invention is directed to an electrical connector comprising an insulative housing and a retainer assembled into the insulative housing. The insulative housing having a mating face and a mounting face opposite to each other, and comprising a plurality of passageways passing through thereof along a front-and-back direction for receiving corresponding contacts and a receiving cavity recessed backwards from the mating face. The retainer is provided with a plurality of first latching portions and a plurality of second latching portions, and the first latching portions and the second latching portions are staggered along the front-and-back direction, the retainer is assembled and locked in the insulative housing without dropping out of the insulative housing via the first latching portions; after the contacts assembled into the insulative housing, the retainer is pushed towards the mounting face by an external force, until the second latching portions locked in receiving cavity.

As further improvement of the present invention, the insulative housing defines a plurality of elastic walls extending forwards, each elastic wall is located between the corresponding passageway and the receiving cavity along a height direction, and provided with a stopper protruding towards the corresponding passageway, the stopper is latching with the relative contact.

As further improvement of the present invention, the retainer is pushed into the receiving cavity backwards via an external force, the retainer is extruding the elastic walls to make the stopper of each elastic wall move toward an interior of the corresponding passageway.

As further improvement of the present invention, the insulative housing further has a limiting wall in the front thereof, and the mating face is formed by a front end of the limiting wall, while the retainer fixed into the receiving cavity, the limiting wall is located in front of the first latching portions or the second latching portions, and a rear surface of the limiting wall is abutting against the first latching portions or the second latching portions.

As further improvement of the present invention, a pair of slant stopping surfaces are defined in the receiving cavity and extending backwards from the mating face, the pair of stopping surfaces are stretching slantwise to make the receiving cavity have a large opening at the front end thereof and a small opening at the back end of the stopping surfaces.

As further improvement of the present invention, the retainer has an inserting portion and a front tip portion opposite to each other, the inserting portion is inserted into the receiving cavity and abutting against every elastic wall on an opposite side with respect to the stopper thereof.

As further improvement of the present invention, each contact is provided with a primary portion, a pair of contacting arms extending forwardly from the primary portion and a tail portion extending backward from the primary portion, and the primary portion defines a positioning mechanism locking with the corresponding stopper.

As further improvement of the present invention, each elastic wall further has a distal section in front of the stopper, when the retainer is pushed rearward by an external force, the distal section of each elastic wall is pushing the side close to the elastic wall of the contacting arm, and the contacting arm is moving far away from the elastic wall.

As further improvement of the present invention, each contact further defines a pair of protecting arm integrally connecting with the primary portion respectively, and each protecting arm is located on a non-mating side of the corresponding contacting arm.

As further improvement of the present invention, the primary portion is provided with a pair of opposite main sections, a connecting section connected with the same side edge of the pair of main sections, and a pair of extension portions folding outward from an open a side opposite to the connecting section of the corresponding main sections, each extension portion and the corresponding main section are extending in the opposite direction, each protecting arm is extending forwardly from a front end of the relative extension portion.

As further improvement of the present invention, the inserting portion is tapering toward an insertion end of the retainer in the height direction.

The present invention is also directed to an electrical connector comprising an insulative housing and a retainer, the insulative housing defines a front mating face and a rear mounting face, and is provided with a receiving cavity and two rows of passageways both recessed backwards from the mating face, the receiving cavity is extending along a transverse direction to form a strip-like shape and sandwiched between the two rows of passageways. The retainer has a plurality of first latching portions and a plurality of second latching portions on both an upper surface and a lower surface, and the first latching portions are closer to an insertion end of the retainer than the second latching portions, the retainer is inserted into the receiving cavity until the first latching portions passing across a rear surface of a limiting wall to make the retainer be fixed in a temporary locking position, when the second latching portions passing across the rear surface, the retainer is fixed in a final locking position.

As further improvement of the present invention, the electrical connector further comprises a plurality of contacts receiving in the corresponding passageways, an elastic wall is correspondingly arranged with each passageway, a stopper protruding on each elastic wall is latching with the relative contact and locked more in depth when the retainer fixed in a final locking position.

As further improvement of the present invention, the first latching portions and the second latching portions are staggered along the transverse direction to be inserted into different passageways.

The retainer and the contacts of the electrical connector can be assembled conveniently, and the retainer is not so easily lost during the transport, furthermore, a sufficient contact holding force between the contacts and the insulative housing can be obtained, and the contacts can better contact with the complementary contacts.

Other objects, advantages and novel features of the invention will become more apparent from the following detailed description of the present embodiment when taken in conjunction with the accompanying drawings.

DETAILED DESCRIPTION OF THE EMBODIMENTS

Figure 1:
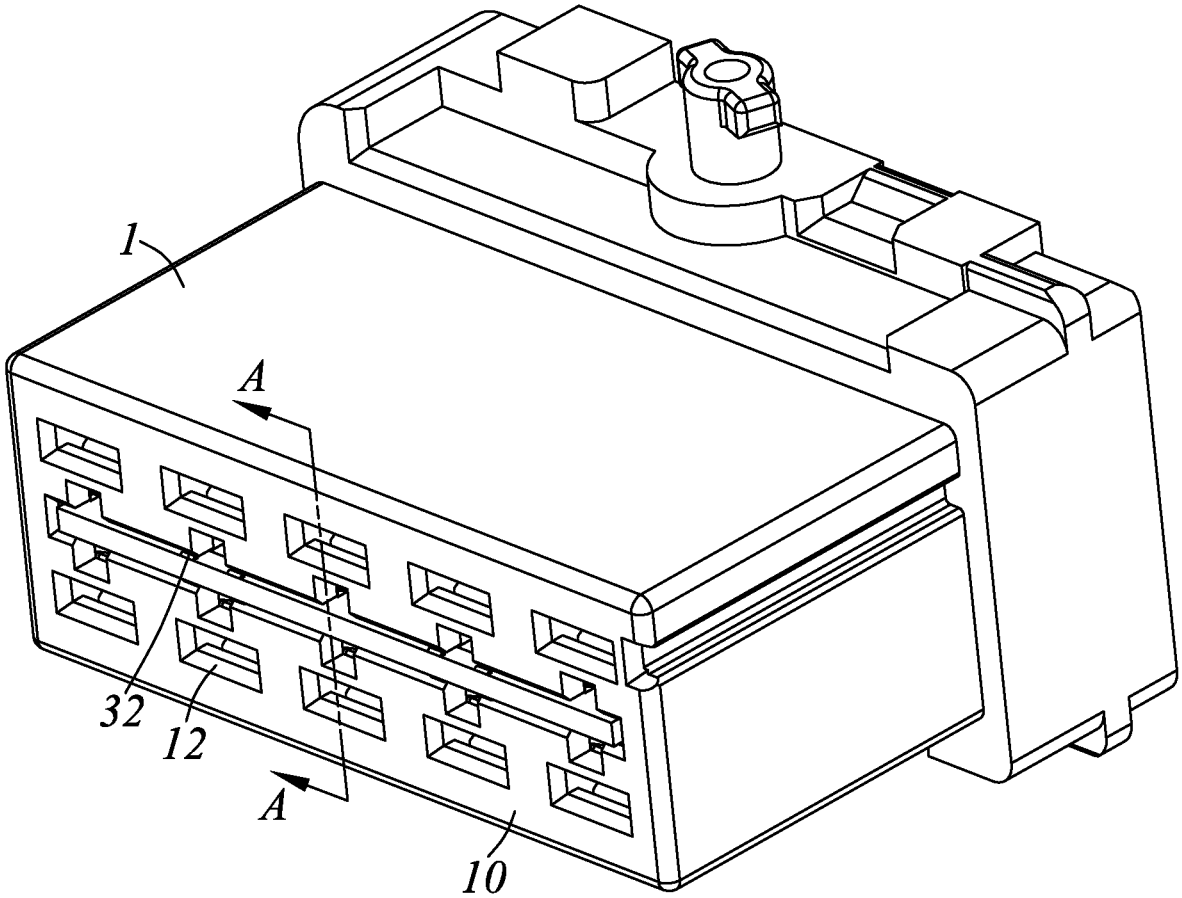
FIG. 1 is an assembled perspective view of an electrical connector in accordance with the present invention.
Figure 2:
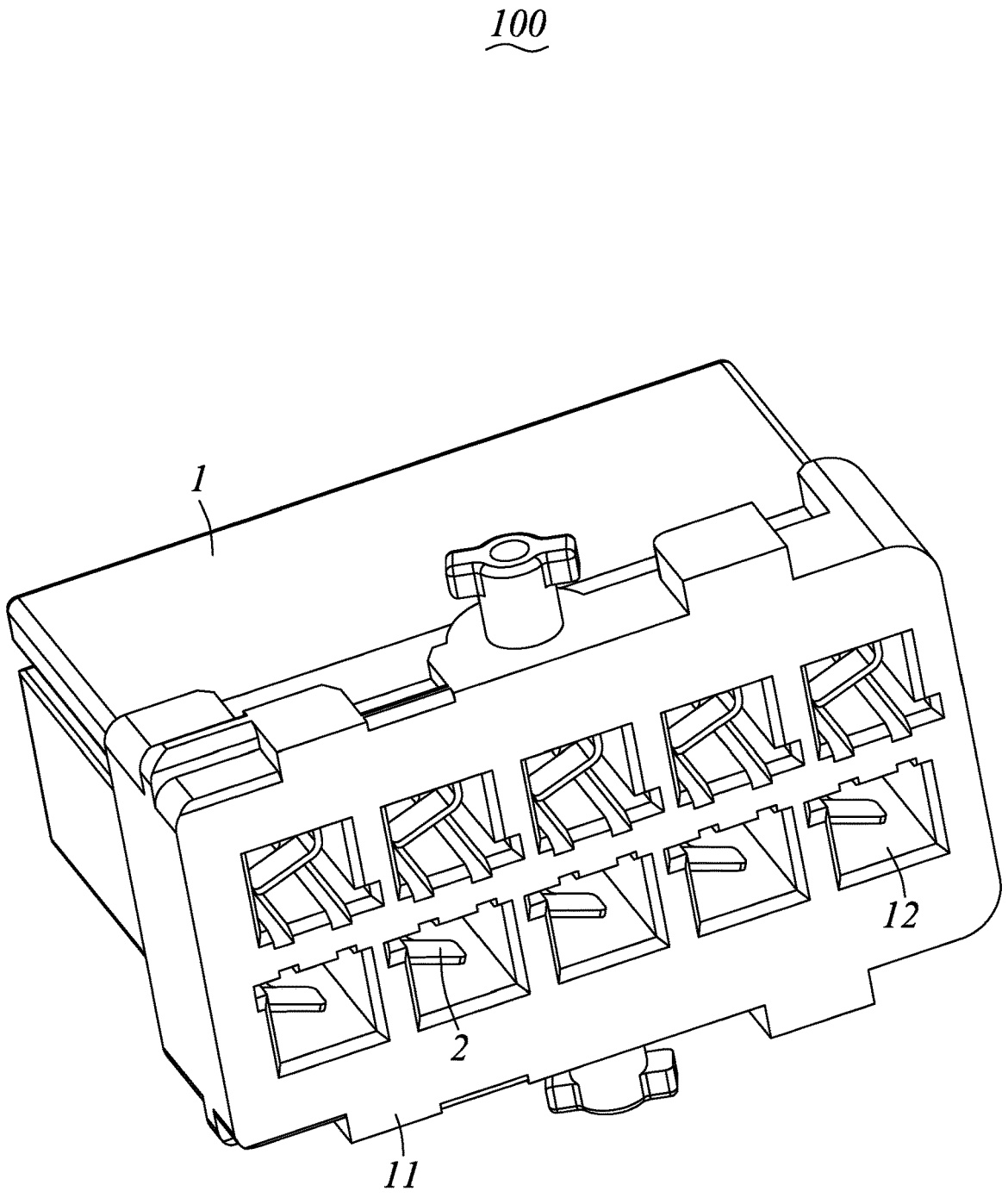
FIG. 2 is similar to FIG. 1, but shown from a different aspect.
Figure 3:
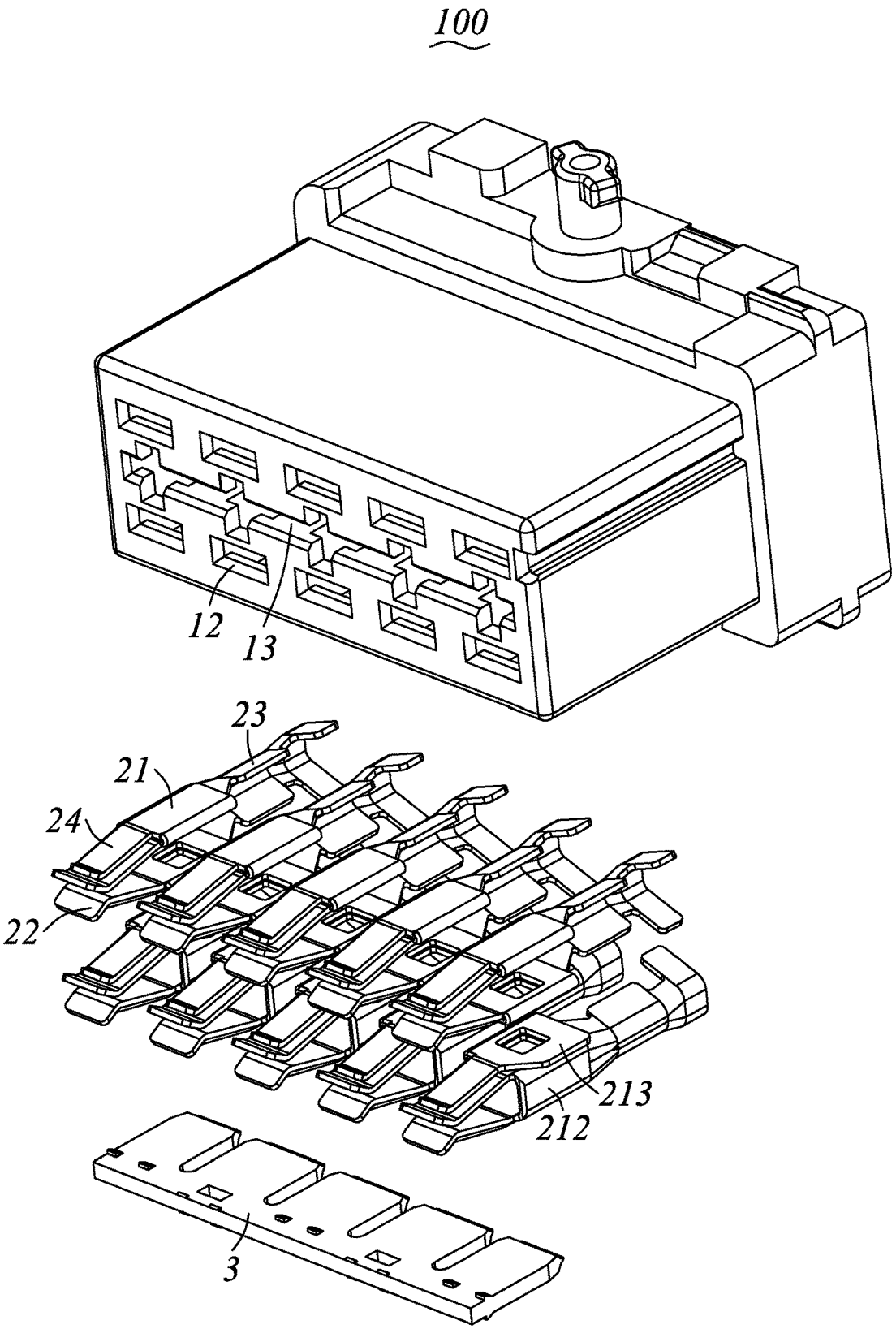
FIG. 3 is an exploded view of the electrical connector shown in FIG. 1.
Figure 4:
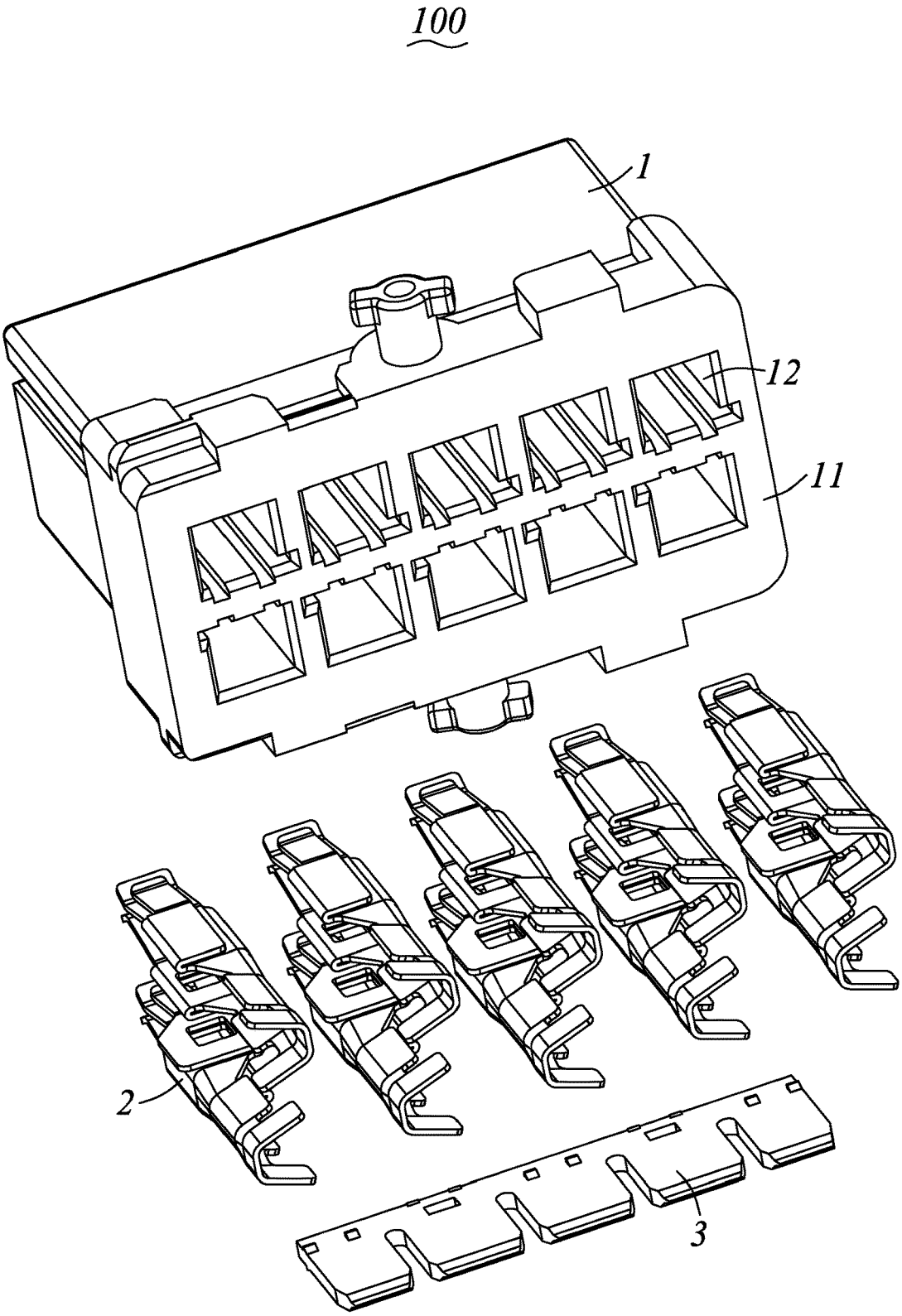
FIG. 4 is similar to FIG. 3, but shown from a different aspect.
Figure 5:
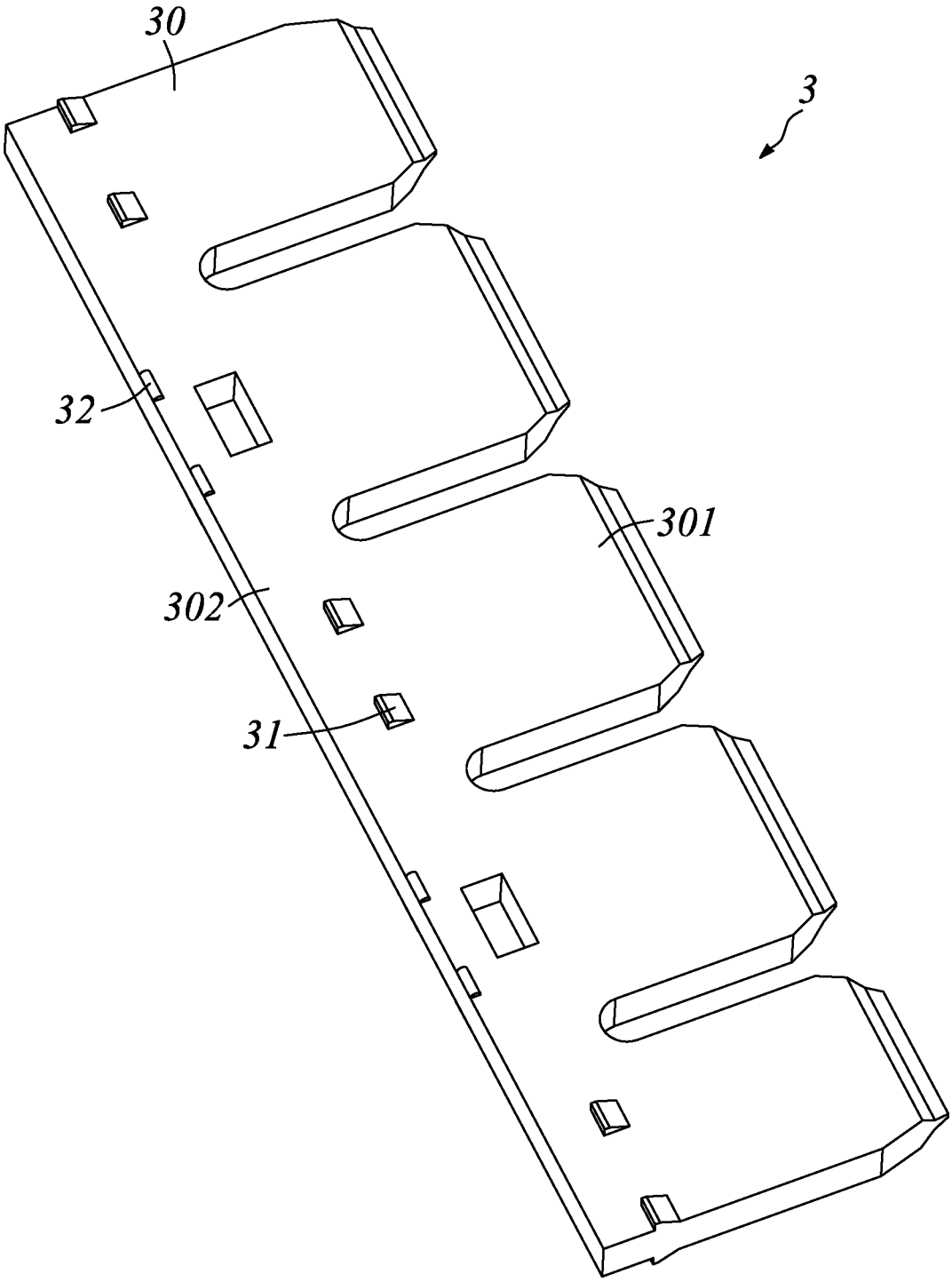
FIG. 5 is a perspective view of a retainer of the electrical connector shown in FIG. 3.
Figure 6:
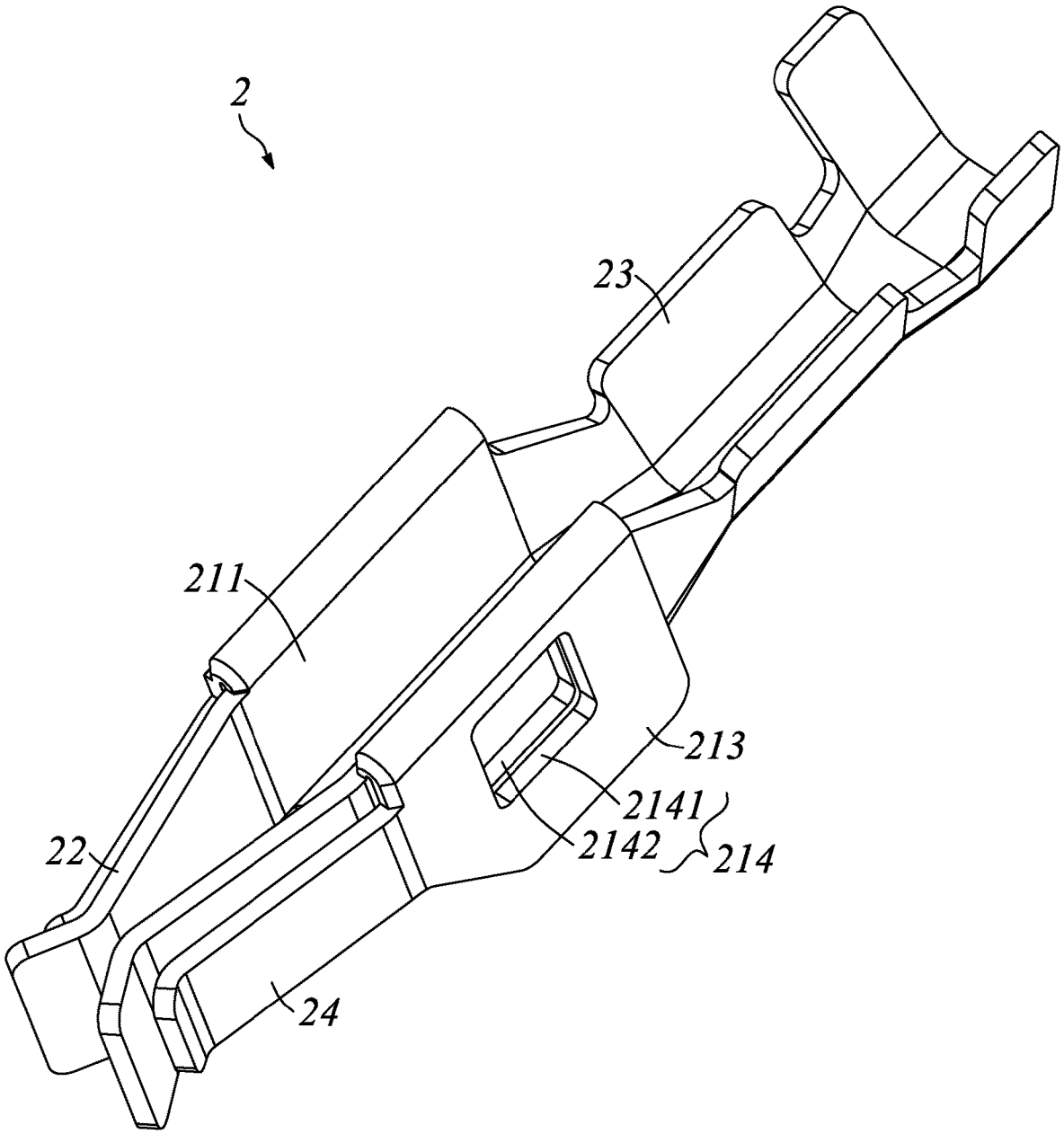
FIG. 6 is a perspective view of a contact of the electrical connector shown in FIG. 3.

Reference will be made to the drawing figures to describe the present invention in detail, wherein depicted elements are not necessarily shown to scale and wherein like of similar elements are designated by same or similar reference numeral through the several views and same or similar terminology.

Please refer to FIG. 1 to FIG. 11, showing an electrical connector 100 in present invention, the electrical connector 100 comprises an insulative housing 1, a plurality of contacts 2 retained in the insulative housing 1 and a retainer 3 assembled to the insulative housing 1.

Referring to FIG. 1 to FIG. 4, and combination with FIG. 7 to FIG. 11, the insulative housing 1 has a mating face 10 and a mounting face 11 opposite to each other, and comprises a plurality of passageways 12 passing through thereof along a front-and-back direction and a receiving cavity 13 recessed backwards from the mating face 10.

In the present embodiment of the invention, two rows of the passageways 12 are arranged along a height direction, and the receiving cavity 13 is disposed between the two rows of the passageways 12 along the height direction. The receiving cavity 13 is extending along the transverse direction to form a strip-like shape, and communicated with the two rows of the passageways 12. In other alternative embodiments, the electrical connector 100 also can has more rows of the passageways 12, and there is one receiving cavity 13 between every two neighboring rows of the passageways 12. A pair of slant stopping surfaces 131 are defined in the receiving cavity 13 and extending backwards from the mating face 10. The pair of stopping surfaces 131 are stretching slantwise to make the receiving cavity 13 have a large opening at the front end thereof and a small opening at the back end of the stopping surfaces 131, thus the retainer 3 can be inserted conveniently and limited by the stopping surfaces 131.

The insulative housing 1 defines a plurality of elastic walls 14 extending forwards, each elastic wall 14 is located between the corresponding passageway 12 and the receiving cavity 13 along the height direction, and there is a one-to-one correspondence between the passageway 12 and the elastic wall 14. Each elastic wall 14 is provided with a stopper 141 protruding towards the corresponding passageway 12, and the stopper 141 is latching with the relative contact 2. Each elastic wall 14 further has a distal section 142 in front of the stopper 141.

In the preferred embodiment, every two passageways 12 correspondingly arranged along the height direction have two elastic walls 14 in a group extending in a same direction. The two elastic walls 14 in a group are connected with each other via rear sections thereof, and front sections of the two elastic walls 14 are spaced apart from each other in the height direction, and the front end of each elastic wall is a free end. Furthermore, every two elastic walls 14 correspondingly arranged along the height direction are in a mirrored relationship with each other, and located between two rows of the passageways 12 along the height direction. The elastic walls 14 one-to-one correspond to the passageways 12, a plug space is formed between every two elastic walls 14 correspondingly arranged along the height direction for the retainer 3 plugging.

The insulative housing 1 further has a limiting wall 15 in the front thereof, and the mating face 10 is formed by a front end of the limiting wall 15. The limiting wall 15 has a rear surface 150 opposite to the mating face 10, the rear surface 150 is facing towards the rear and located in the passageways 12.

Figure 9:
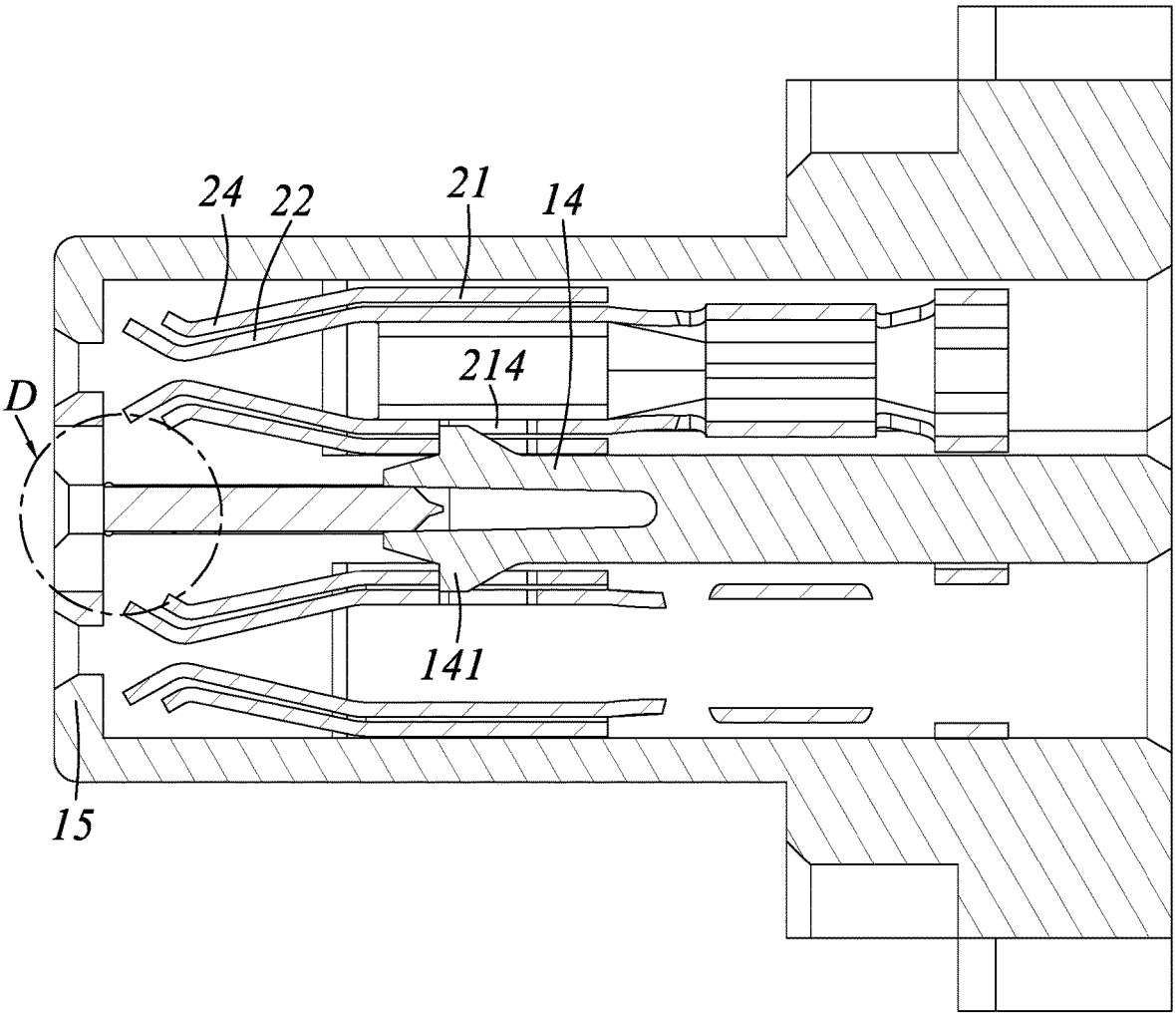
FIG. 9 is a sectional view along line B-B in FIG. 8.

Referring to FIG. 3 to FIG. 4, FIG. 6 to FIG. 7 and conjunction with FIG. 9, in the present embodiment, each contact 2 is provided with a primary portion 21, a pair of contacting arms 22 extending forwardly from the primary portion 21 and a tail portion 23 extending backward from the primary portion 21. The primary portion 21 defines a positioning mechanism 214 locking with the stopper 141, to prevent the relative contact 2 from shaking in the insulative housing 1. Each contacting arm 22 has a mating side contacting with a complementary contact and a non-mating side opposite to the mating side.

Each contact 2 further defines a pair of protecting arm 24 integrally connecting with the primary portion 21 respectively, and each protecting arm 24 is located on the non-mating side of the corresponding contacting arm 22.

The primary portion 21 is provided with a pair of opposite main sections 211 and a connecting section 212 connected with the same side edge of the pair of main sections 211.

Each contacting arm 22 is extending forwardly from the corresponding main section 211.

In the present embodiment, each contact 2 further has a pair of extension portions 213 folding outward from a side opposite to the connecting section 212 of the corresponding main sections 211, thus each extension portion 213 and the corresponding main section 211 are extending in the opposite direction. Each protecting arm 24 is extending forwardly from the relative extension portion 213, and the two extension portions 213 in the pair have different extending lengths in the transverse direction, so the pair of extension portions 213 are assembled into the insulative housing 1 along a predetermined direction. In other alternative embodiments, the pair of protecting arms 24 also can be bending forwardly from a rear end or a middle part of the corresponding main sections 211 directly. Additionally, the pair of extension portions 213 can be bending forwardly from a rear end or a middle part of the corresponding main sections 211, and then the protecting arms 24 are extending forwardly from front ends of the corresponding extension portions 213.

A first receiving portion 2141 defined on one of the extension portion 213 is served as the positioning mechanism 214. Furthermore, the first receiving portion 2141 is defined on the extension portion 213 which has a larger extending length, and a second receiving portion 2142 is disposed on the corresponding main section 211 inside of the extension portion 213 with a larger extending length. The first receiving portion 2141 and the second receiving portion 2142 are aligned with each other to form the positioning mechanism 214 together. In other alternative embodiments, the first receiving portion 2141 also can be defined on the extension portion 213 having a smaller extending length, and the second receiving portion 2142 is disposed on the inside corresponding main section 211.

In the present embodiment, a positioning hole is penetrating through the primary portion 21 in a thickness direction thereof and served as the positioning mechanism 214, in further, the first receiving portion 2141 is penetrating through the corresponding extension portion 213 along the thickness direction, and the second receiving portion 2142 is penetrating through the inside corresponding main section 211 in the thickness direction. The first receiving portion 2141 and the second receiving portion 2142 are aligning with each other, and communicated with each other to form the positioning mechanism 214. In other alternative embodiments, the positioning mechanism 214 also can be a depression or other structures that can form a latching relationship.

The retainer 3 has a base portion 30, a plurality of first latching portions 31 defined on both sides of the base portion 30 along the height direction and a plurality of second latching portions 32, and the second latching portions 32 are also distributed on both sides of the base portion 30 along the height direction. The first latching portions 31 and the second latching portions 32 are staggered along the front-and-back direction and the transverse direction. In the present invention, the second latching portions 32 are neighboring to a front end of the base portion 30, and the first latching portions 31 are located behind the second latching portions 32. The first latching portions 31 and the second latching portions 32 are arranged alternately along the transverse direction, and correspondingly aligned with different passageways 12. Additionally, the first latching portions 31 are arranged in pairs with the second latching portions 32 disposed in pairs also, every two adjacent first latching portions 31 are defined as a pair of first latching portions 31 corresponding to the same one passageway 12, every two adjacent second latching portions 32 are defined as a pair of second latching portions 32 corresponding to another adjacent passageway 12.

Figure 7:
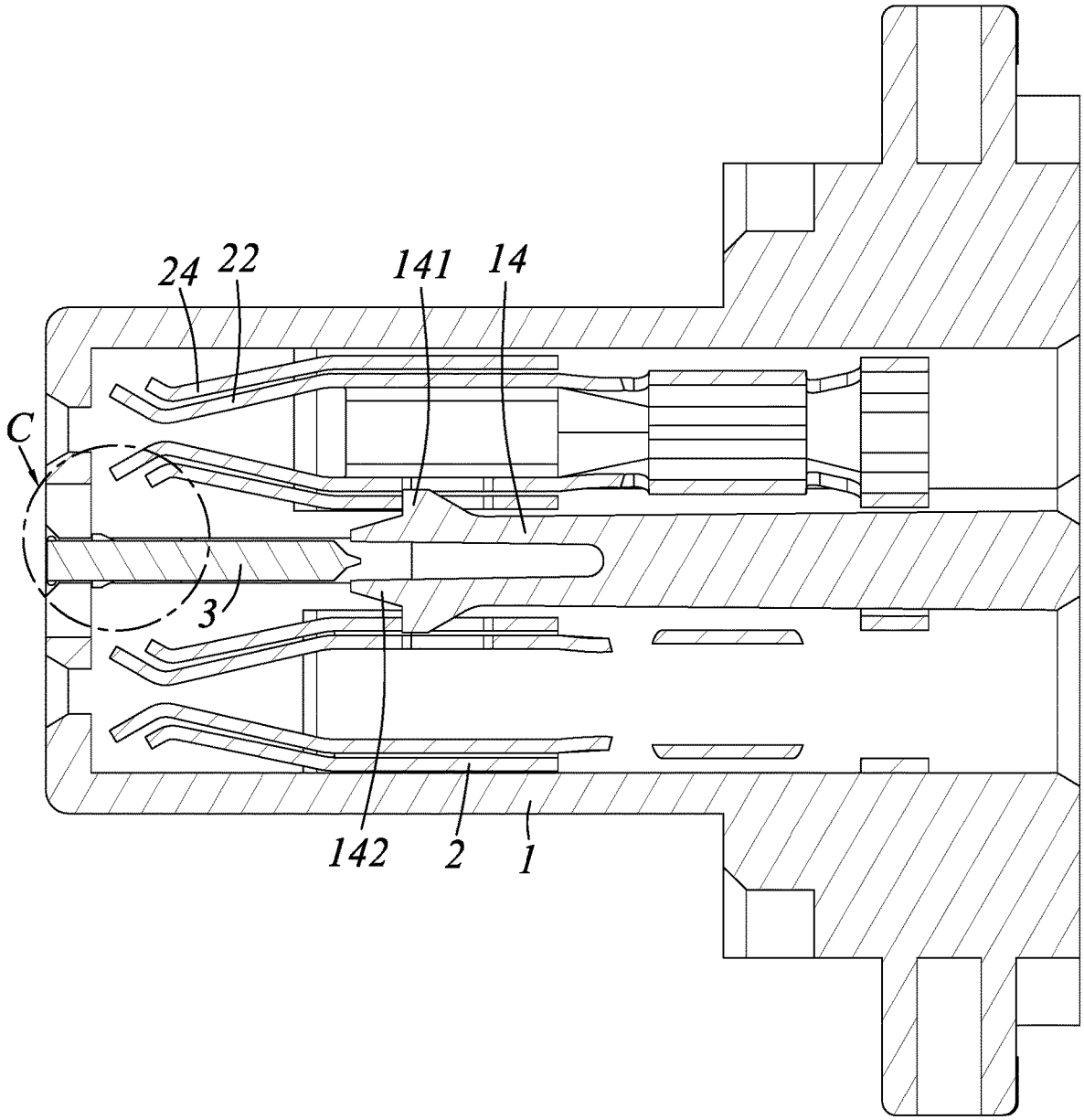
FIG. 7 is a sectional view along line A-A in FIG. 1.
Figure 10:
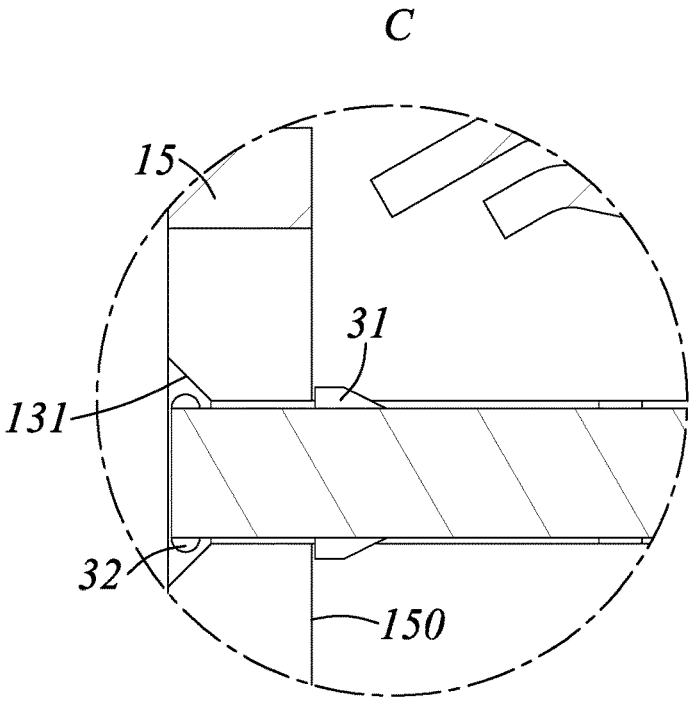
FIG. 10 is an enlarged view of part C in FIG. 7.

Referring to FIG. 1, FIG. 7 and FIG. 10, in the preassembly process, the retainer 3 is inserted into the receiving cavity 13 rearwards from the mating face 10, and the first latching portions 31 is moving backwards until crossing the limiting wall 15 and locked by the rear surface 150 of the limiting wall 15, thus the retainer 3 can be prevented from dropping out of the insulative housing 1. Simultaneously, because of the second latching portions 32 has not yet passed into the receiving cavity 13, and been kept out of the receiving cavity 13 by a pair of stopping surfaces 131, therefore, before the contacts 2 being assembled into the insulative housing 1, the retainer 3 can be prevented from passing across the limiting wall 15 by a wrong pushing force, thereby avoiding the inconvenient assembly of the contacts 2.

In the preassembly position (temporary locking position), the retainer 3 is assembled into the receiving cavity 13 and locked in the receiving cavity 13 by the first latching portions 31 to prevent dropping out, thus the retainer 3 can be kept in the preassembly position without falling during transportation and other processes. After the contacts 2 have been assembled into the insulative housing 1, the retainer 3 is pushed towards the mounting face 11 by an external force, until the second latching portions 32 locked behind the rear surface 150.

The base portion 30 has an inserting portion 301 and a front tip portion 302 opposite to each other, and the inserting portion 301 is tapering toward an insertion end of the base portion 30, thus can be inserted into the receiving cavity 13 easily. The inserting portion 301 is inserted into the receiving cavity 13 and abutting against every elastic wall 14 on an opposite side with respect to the stopper 141 thereof.

Figure 8:
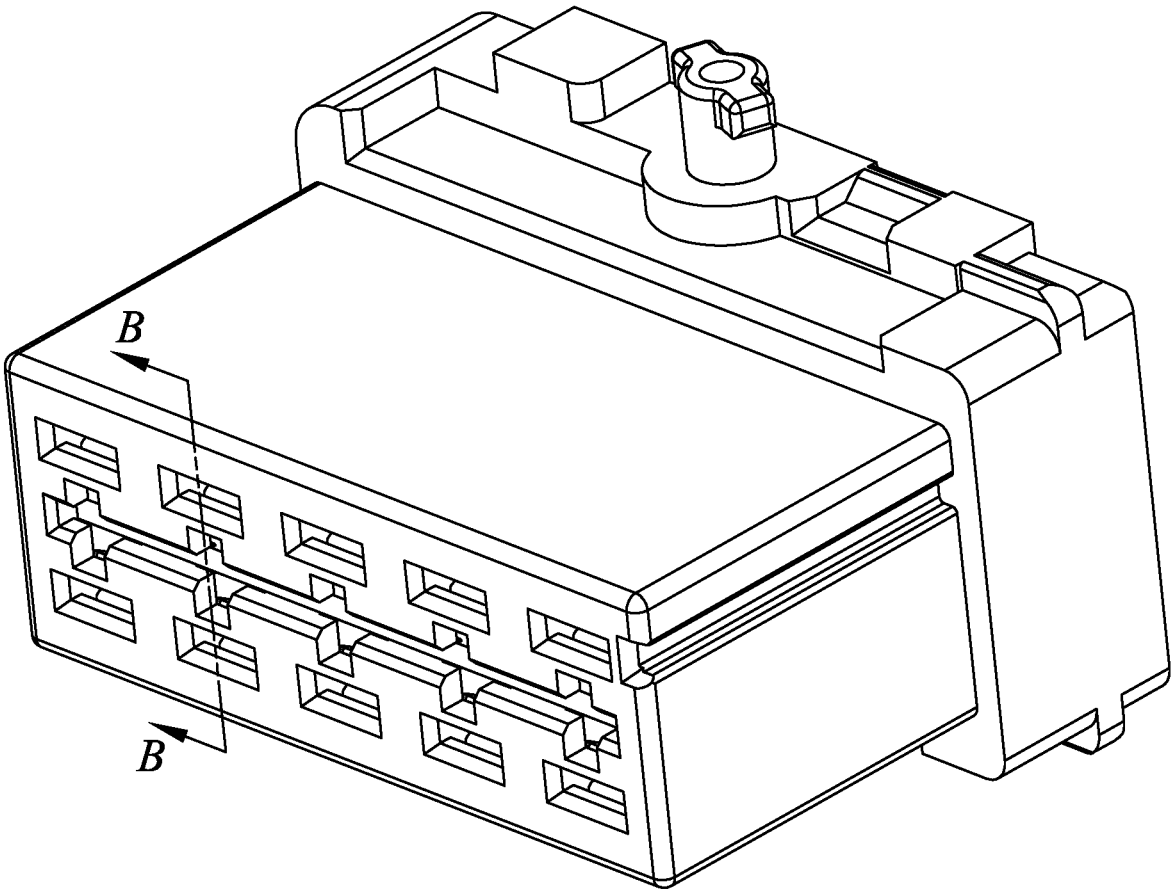
FIG. 8 is a perspective view showing the retainer being pressed into an insulative housing by an external force of the electrical connector of FIG. 1.
Figure 11:
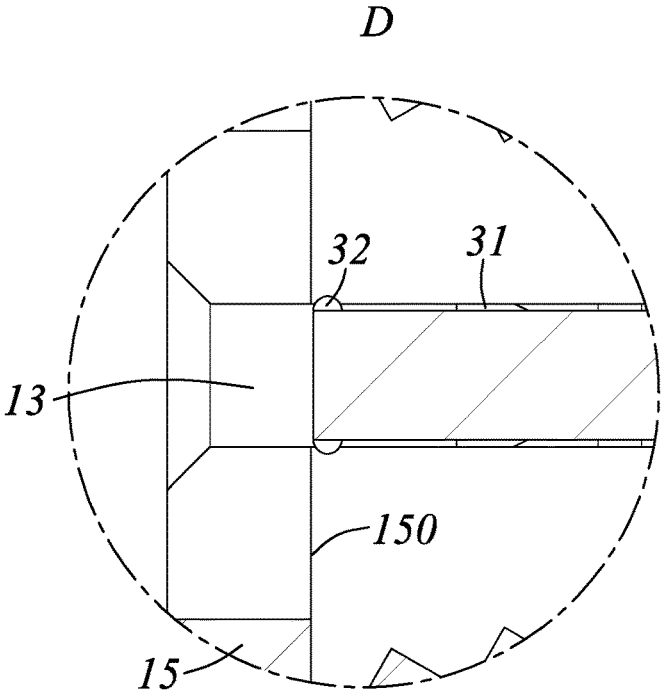
FIG. 11 is an enlarged view of part D in FIG. 9.

Referring to FIGS. 8-9, and conjunction with FIG. 11, when the retainer 3 pushed into the receiving cavity 13 backwards via a complementary connector or an external force exerted by a tool, the inserting portion 301 of the retainer 3 is extruding the elastic walls 14, to make the stopper 141 of each elastic wall 14 move toward an interior of the corresponding passageway 12, therefore the stoppers 141 can be locked in the positioning mechanism 214 more in depth, and a sufficient contact holding force between the contacts 2 and the insulative housing 1 can be obtained, a strong retaining force between the contacts 2 and wires (not shown) during the welding process can be accomplished.

While the retainer 3 fixed into the receiving cavity 13, the limiting wall 15 is located in front of the first latching portions 31 or the second latching portions 32, and the rear surface 150 is abutting against the first latching portions 31 or the second latching portions 32.

When the retainer 3 is pushed rearward by an external force, the distal section 142 of each elastic wall 14 is pushing the neighboring protecting arm 24 by the force from the inserting portion 301, and then the side close to the elastic wall 14 of the contacting arm 22 is pushed, and the contacting arm 22 is moving far away from the elastic wall 14, then the opposite contacting arms 22 are drawing close to one another. When mating with a complementary contact (not shown), each contact 2 can clamp the complementary contact via the pair of contacting arms 22, thereby forming a strong retaining force and a better stability.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a mating face and a mounting face opposite to each other, and comprising a plurality of passageways passing through thereof along a front-and-back direction for receiving corresponding contacts and a receiving cavity recessed backwards from the mating face; and a retainer assembled into the insulative housing;

wherein the retainer is provided with a plurality of first latching portions and a plurality of second latching portions, and the first latching portions and the second latching portions are staggered along the front-and-back direction, the retainer is assembled and locked in the insulative housing without dropping out of the insulative housing via the first latching portions; after the contacts assembled into the insulative housing, the retainer is pushed towards the mounting face by an external force, until the second latching portions locked in receiving cavity, the insulative housing further has a limiting wall in the front thereof, and the mating face is formed by a front end of the limiting wall, while the retainer fixed into the receiving cavity, the limiting wall is located in front of the first latching portions or the second latching portions, and a rear surface of the limiting wall is abutting against the first latching portions or the second latching portions.

2. The electrical connector as claimed in claim 1, wherein the insulative housing defines a plurality of elastic walls extending forwards, each elastic wall is located between the corresponding passageway and the receiving cavity along a height direction, and provided with a stopper protruding towards the corresponding passageway, the stopper is latching with the relative contact.

3. The electrical connector as claimed in claim 2, wherein the retainer is pushed into the receiving cavity backwards via an external force, the retainer is extruding the elastic walls to make the stopper of each elastic wall move toward an interior of the corresponding passageway.

4. The electrical connector as claimed in claim 3, wherein the retainer has an inserting portion and a front tip portion opposite to each other, the inserting portion is inserted into the receiving cavity and abutting against every elastic wall on an opposite side with respect to the stopper thereof.

5. The electrical connector as claimed in claim 4, wherein each contact is provided with a primary portion, a pair of contacting arms extending forwardly from the primary portion and a tail portion extending backward from the primary portion, and the primary portion defines a positioning mechanism locking with the corresponding stopper.

6. The electrical connector as claimed in claim 5, wherein each elastic wall further has a distal section in front of the stopper, when the retainer is pushed rearward by an external force, the distal section of each elastic wall is pushing the side close to the elastic wall of the contacting arm, and the contacting arm is moving far away from the elastic wall.

7. The electrical connector as claimed in claim 6, wherein each contact further defines a pair of protecting arm integrally connecting with the primary portion respectively, and each protecting arm is located on a non-mating side of the corresponding contacting arm.

8. The electrical connector as claimed in claim 7, wherein the primary portion is provided with a pair of opposite main sections, a connecting section connected with the same side edge of the pair of main sections, and a pair of extension portions folding outward from a side opposite to the connecting section of the corresponding main sections, each extension portion and the corresponding main section are extending in the opposite direction, each protecting arm is extending forwardly from a front end of the relative extension portion.

9. The electrical connector as claimed in claim 1, wherein a pair of slant stopping surfaces are defined in the receiving cavity and extending backwards from the mating face, the pair of stopping surfaces are stretching slantwise to make the receiving cavity have a large opening at the front end thereof and a small opening at the back end of the stopping surfaces.

10. The electrical connector as claimed in claim 9, wherein the inserting portion is tapering toward an insertion end of the retainer in the height direction.

11. An electrical connector, comprising:

an insulative housing defining a front mating face and a rear mounting face, and provided with a receiving cavity and two rows of passageways both recessed backwards from the mating face, the receiving cavity extending along a transverse direction to form a strip-like shape and sandwiched between the two rows of passageways; and a retainer having a plurality of first latching portions and a plurality of second latching portions on both an upper surface and a lower surface;

wherein the first latching portions are closer to an insertion end of the retainer than the second latching portions, the retainer is inserted into the receiving cavity until the first latching portions passing across a rear surface of a limiting wall to make the retainer be fixed in a temporary locking position, when the second latching portions passing across the rear surface, the retainer is fixed in a final locking position.

12. The electrical connector as claimed in claim 11, wherein the electrical connector further comprises a plurality of contacts receiving in the corresponding passageways, an elastic wall is correspondingly arranged with each passageway, a stopper protruding on each elastic wall is latching with the relative contact and locked more in depth when the retainer fixed in a final locking position.

13. The electrical connector as claimed in claim 11, wherein the first latching portions and the second latching portions are staggered along the transverse direction to be inserted into different passageways.

14. An electrical connector, comprising:

an insulative housing having a mating face and a mounting face opposite to each other, and comprising a plurality of passageways passing through thereof along a front-and-back direction for receiving corresponding contacts, a receiving cavity recessed backwards from the mating face and two rows of elastic walls extending forwards; and a retainer assembled into the insulative housing;

wherein the retainer is of a tongue shape and provided with a plurality of first latching portions and a plurality of second latching portions, the first latching portions and the second latching portions are staggered along the front-and-back direction, the retainer is assembled and locked in the insulative housing without dropping out of the insulative housing via the first latching portions; after the contacts assembled into the insulative housing, the retainer is pushed towards the mounting face by an external force and an inserting portion of the retainer enters into an plugging space formed between the two rows of elastic walls, until the second latching portions locked in receiving cavity and the inserting portion pressing against the two rows of elastic walls on both sides thereof to move in opposite directions.

15. The electrical connector as claimed in claim 14, wherein the retainer has a base portion, the first latching portions and the second latching portions are protruding upwards and downwards from the base portion.

16. The electrical connector as claimed in claim 14, wherein the inserting portion is tapering toward an insertion end of the base portion.

17. The electrical connector as claimed in claim 14, wherein each contact is provided with a primary portion, a pair of contacting arms extending forwardly from the primary portion and a pair of protecting arm integrally connecting with the primary portion respectively.

18. The electrical connector as claimed in claim 17, wherein while the retainer is pushed rearward by an external force, a distal section of each elastic wall is pushing the neighboring protecting arm by the force from the inserting portion, and then the side close to the elastic wall of the contacting arm is pushed, and the contacting arm is moving far away from the elastic wall, then the opposite contacting arms are close to each other.

19. The electrical connector as claimed in claim 14, wherein the contacts are divided into two rows with a same structure, and the posture of one row of contacts is the posture of the other row of contacts after rotating 180 degrees.

20. The electrical connector as claimed in claim 14, wherein every two elastic walls are arranged correspondingly along a height direction and defined in a group, two elastic walls in a group are extending in a same direction and connected with each other via rear sections thereof, and front sections of the two elastic walls are spaced apart from each other in the height direction to form a U-shaped configuration.

* * * * *